US007505713B2

(12) United States Patent
Lee et al.

(10) Patent No.: US 7,505,713 B2
(45) Date of Patent: Mar. 17, 2009

(54) ROLLERS SEPARATING UNIT AND IMAGE FORMING APPARATUS HAVING THE SAME

(75) Inventors: Bong-hee Lee, Suwon-si (KR); Ho-min Lim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 343 days.

(21) Appl. No.: 11/290,600

(22) Filed: Dec. 1, 2005

(65) Prior Publication Data

US 2006/0239715 A1 Oct. 26, 2006

(30) Foreign Application Priority Data

Apr. 20, 2005 (KR) ..... 10-2005-0032814

(51) Int. Cl.
*G03G 15/16* (2006.01)

(52) U.S. Cl. ..... 399/122

(58) Field of Classification Search ..... 399/122, 399/124, 320, 330, 331; 219/216
See application file for complete search history.

(56) References Cited

U.S. PATENT DOCUMENTS 4,384,781 A * 5/1983 Takada ..... 399/122
4,421,401 A * 12/1983 Kagiura et al. ..... 399/122
5,105,228 A * 4/1992 Kato ..... 399/122
5,300,998 A * 4/1994 Ogisawa et al. ..... 399/124
5,956,547 A * 9/1999 Kamei et al. ..... 399/122
6,292,638 B1 * 9/2001 Nagamine et al. ..... 399/122
6,904,257 B2 * 6/2005 Tomatsu ..... 399/328
6,950,619 B2 * 9/2005 Sunohara ..... 399/124

FOREIGN PATENT DOCUMENTS

JP 03075776 A * 3/1991
JP 05-173440 7/1993
JP 08185076 A * 7/1996
JP 09-218543 8/1997
JP 2000-214718 8/2000
JP 2000338815 A * 12/2000

(Continued)

OTHER PUBLICATIONS

Office Action issued in Korean Patent Application No. 2005-32814 on May 25, 2006.

*Primary Examiner*—Robert Beatty
(74) *Attorney, Agent, or Firm*—Stein, McEwen & Bui, LLP

(57) ABSTRACT

A rollers separating unit which controls a distance between a heating roller and a pressurizing roller of a fixing unit by an opening/closing of a side cover. The rollers separating unit includes an elastic support member rotatably hinge-coupled to one side of a housing of a fixing unit, to elastically support a roller installed at an outer portion of a main body between a pair of rollers so that the pair of rollers pressurize each other, a first lever rotatably hinge-coupled to one end of the elastic support member, to rotate the elastic support member at a first predetermined angle so that the pair of rollers are separated from each other, and a side cover rotatably hinge-coupled to one side of the main body, to increase a distance between the pair of rollers by operating the first lever.

28 Claims, 14 Drawing Sheets

FOREIGN PATENT DOCUMENTS

| | | | |
|---|---|---|---|
| JP | 2001201975 A | * | 7/2001 |
| KR | 1997-4164 | | 3/1997 |
| KR | 1999-009327 | | 3/1999 |
| KR | 1999-0041811 | | 12/1999 |
| KR | 2004-18719 A | | 3/2004 |

* cited by examiner

ROLLERS SEPARATING UNIT AND IMAGE FORMING APPARATUS HAVING THE SAME

CROSS-REFERENCE TO RELATED APPLICATIONS

This application claims the benefit of Korean Application No. 2005-32814, filed Apr. 20, 2005, in the Korean Intellectual Property Office, the disclosure of which is incorporated herein by reference.

BACKGROUND OF THE INVENTION

1. Field of the Invention

An aspect of the present invention relates to an image forming apparatus, and, more particularly, to a rollers separating unit which may separate a heating roller from a pressurizing roller to remove paper jammed in a fixing unit of an image forming apparatus, as well as an image forming apparatus having the same installed therein.

2. Description of the Related Art

In general, in an image forming apparatus, transferring a printing medium on which an image is formed such as paper (hereinafter, referred to as 'paper') and forming an image on the paper increases the possibility that the transferred paper may be jammed.

In particular, an electrophotographic image forming apparatus forms an electrostatic latent image on a photoconductor by laser beams that are emitted from an exposure unit, and develops the electrostatic latent image by a toner so as to form a visible image. Thereafter, the image forming apparatus transcribes the toner to form the visible image to paper, and fixes the toner to the paper by applying pressure and heat by a fixing unit so as to perform a printing operation.

Here, in the fixing unit, a heating roller to apply heat to the paper and a pressurizing roller to apply pressure to the paper are installed to face each other. Accordingly, when the paper on which the toner has been transcribed passes between the heating roller and the pressurizing roller, the toner is fixed to the paper. However, when the paper passing through the fixing unit is jammed between the pressurizing roller and the heating roller, since the pressurizing roller pressurizes the paper to the heating roller, the jammed paper is not easily removed. In order to remove the paper jammed in the fixing unit, the user must open the cover of the image forming apparatus and release pressure of the pressurizing roller. Otherwise, the user must forcibly pull the jammed paper under the pressure of the pressurizing roller. As a result, the user may not easily remove the jammed paper and either the heating roller or the pressurizing roller may be damaged.

SUMMARY OF THE INVENTION

Accordingly, an aspect of the present invention provides a rollers separating unit which allows the user to easily remove jammed paper by releasing pressure of a fixing unit when the user opens a side cover of an image forming apparatus, as well as an image forming apparatus having the same installed therein.

In order to achieve the above-described object of the invention, there is provided a rollers separating unit including: an elastic support member rotatably hinge-coupled to one side of a housing of a fixing unit, to elastically support a roller installed at an outer portion of a main body between a pair of rollers so that the pair of rollers pressurize each other; a first lever rotatably hinge-coupled to one end of the elastic support member, to rotate the elastic support member at a predetermined angle so that the pair of rollers are separated from each other; and a side cover rotatably hinge-coupled to one side of the main body, to increase a distance between the pair of rollers by operating the first lever.

According to an aspect of the invention, the side cover includes a second lever to rotate the first lever so that the elastic support member is rotated in an opening direction of the side cover, when the side cover is opened.

According to an aspect of the invention, the side cover further includes a third lever to rotate the first lever so that the elastic support member is rotated in a closing direction of the side cover, when the side cover is closed.

According to an aspect of the invention, the rollers separating unit further includes a fixing member to fix the first lever to the housing of the fixing unit, when the first lever is rotated in the opening direction of the side cover at a predetermined angle.

The fixing member includes a first fixing protrusion formed at one end of the first lever, and a second fixing protrusion formed in the housing of the fixing unit to correspond to the first fixing protrusion.

According to an aspect of the invention, the rollers separating unit further includes a second elastic member to elastically support the first lever so that the first lever maintains a predetermined angle to the elastic support member when the pair of rollers contact each other.

According to an aspect of the invention, the elastic support member includes a first elastic member installed between the housing of the fixing unit and one end of the elastic support member, to draw the elastic support member in the main body direction.

According to another aspect of the invention, there is provided a rollers separating unit including: a pair of elastic support members rotatably hinge-coupled to both sides of a housing of a fixing unit, to elastically support a pressurizing roller to pressurize a heating roller; a pair of first levers rotatably hinge-coupled to one end of the pair of elastic support members, to rotate the pair of elastic support members at a predetermined angle so that the heating roller and the pressurizing roller are separated from each other; and a side cover rotatably hinge-coupled to one side of a main body, to increase a distance between the heating roller and the pressurizing roller by operating the pair of first levers.

According to an aspect of the invention, the side cover includes a pair of second levers to rotate the pair of first levers so that the elastic support members are rotated in an opening direction of the side cover, when the side cover is opened.

According to an aspect of the invention, the side cover further includes a pair of third levers to rotate the pair of first levers so that the elastic support members are rotated in a closing direction of the side cover, when the side cover is closed.

According to yet another aspect of the invention, there is provided an image forming apparatus having a rollers separating unit including: a pair of elastic support members rotatably hinge-coupled to both sides of a housing of a fixing unit, to elastically support a pressurizing roller to pressurize a heating roller; a pair of first levers rotatably hinge-coupled to one end of the pair of elastic support members, to rotate the pair of elastic support members at a predetermined angle so that the heating roller and the pressurizing roller are separated from each other; and a side cover rotatably hinge-coupled to one side of a main body, to increase a distance between the heating roller and the pressurizing roller by operating the pair of first levers.

As is described above, in the rollers separating unit of the present invention, when the side cover of the image forming apparatus is opened, the pressurizing roller and the heating roller are separated from each other, to release pressure of the fixing unit. Therefore, the user may relatively easily remove jammed paper.

In addition, in the image forming apparatus having the rollers separating unit, the pressurizing roller and the heating roller are separated from each other simply by opening/closing the side cover. As a result, the user may relatively easily remove jammed paper.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
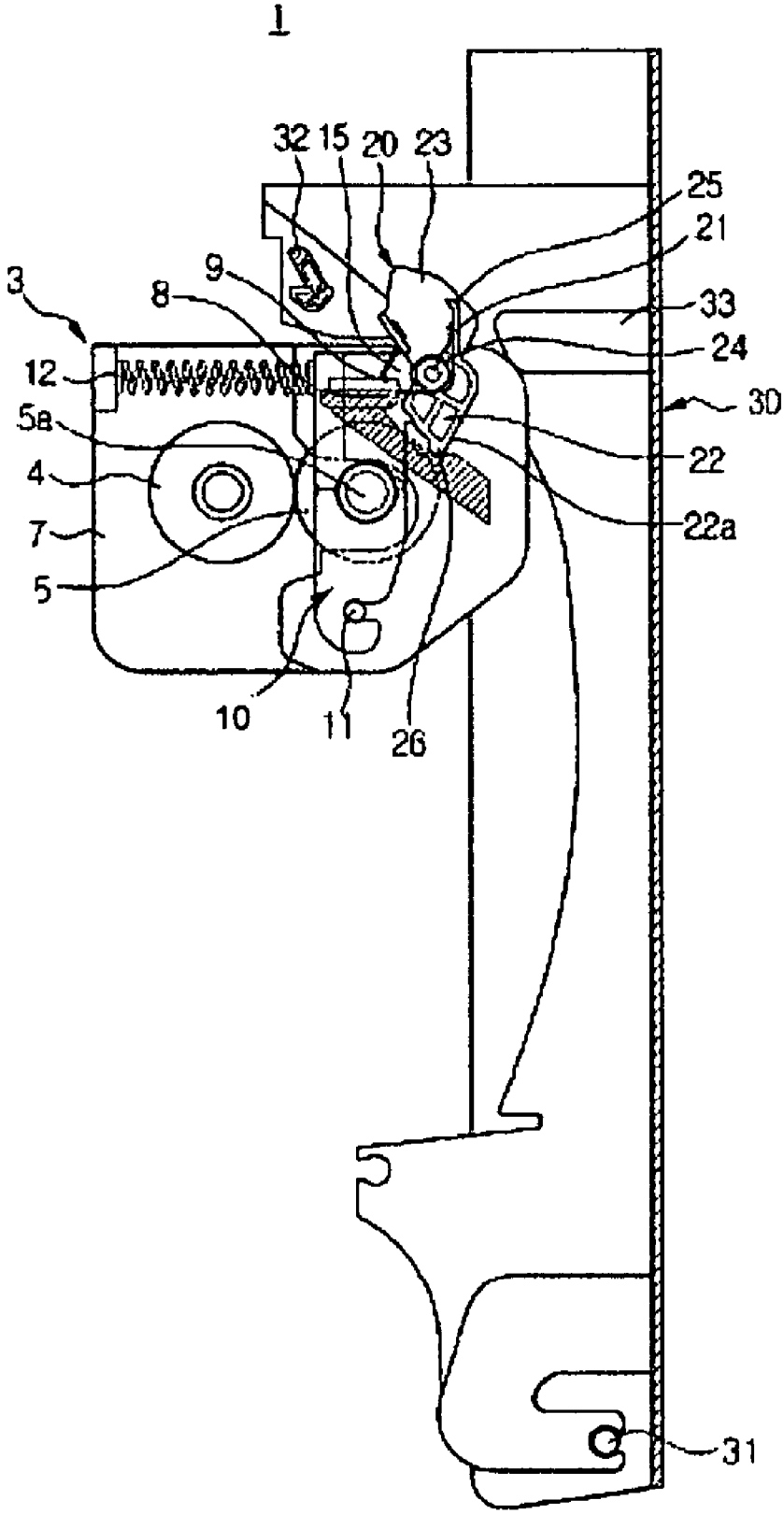
FIG. 1 is a side-sectional diagram illustrating a rollers separating unit in accordance with a first embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
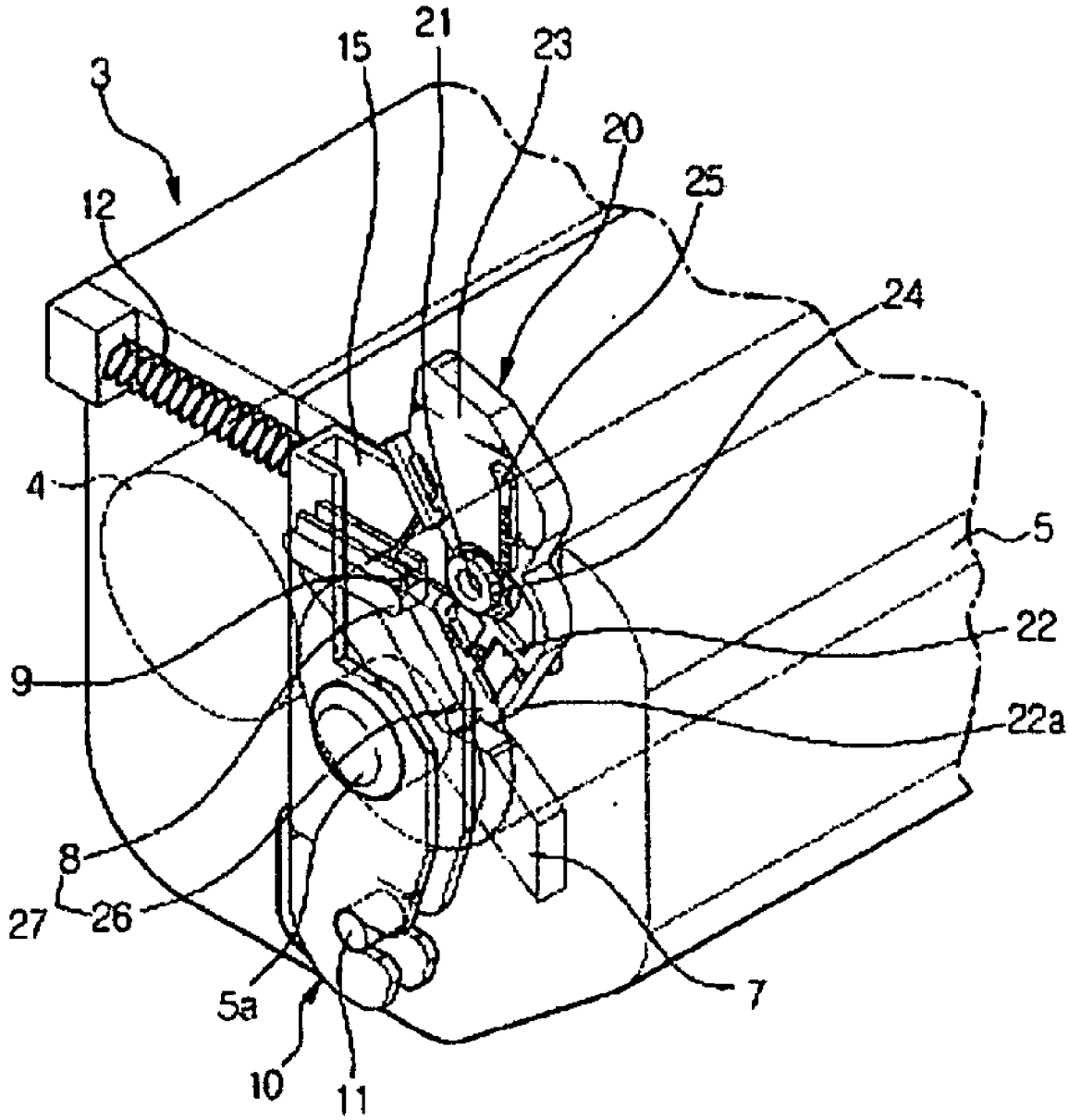
FIG. 2 is a partial perspective diagram illustrating the rollers separating unit of the embodiment of FIG. 1.

Referring to FIGS. 1 and 2, the rollers separating unit 1 is installed in a fixing unit 3, and includes an elastic support member 10, a first lever 20 and a side cover 30.

The fixing unit 3 is installed in a main body 101 (refer to FIG. 7) of the image forming apparatus, and includes a heating roller 4 to generate heat, a pressurizing roller 5 to pressurize the heating roller 4, and a housing 7 to house the heating roller 4 and the pressurizing roller 5.

The elastic support member 10 is rotatably hinge-coupled to one side of the housing 7 of the fixing unit 3. That is, the bottom end of the elastic support member 10 is installed in the housing 7 of the fixing unit 3 by a first hinge 11, and the middle portion thereof rotatably supports an axis 5A of the pressurizing roller 5. In an embodiment of the invention, a bearing to support rotation of the axis 5A of the pressurizing roller 5 is disposed between the elastic support member 10 and the axis 5A of the pressurizing roller 5. In addition, a first elastic member 12 is installed between the top end of the elastic support member 10 and the housing 7 of the fixing unit 3. The first elastic member 12 allows the pressurizing roller 5 to pressurize the heating roller 4 installed at the inner portion of the main body, by rotating the elastic support member 10 on the first hinge 11 to the inner portion of the main body.

The first lever 20 is rotatably hinge-coupled by a second hinge 21 to an extended end 15 outwardly extended from one end of the elastic support member 10, namely, the top end of the elastic support member 10. When the first lever 20 is rotated to the outer portion of the main body (clockwise direction of FIG. 1), an outer surface 22*a* of the bottom end 22 of the first lever 20 interferes with a specific part of the housing 7 of the fixing unit 3. Thus, the elastic support member 10 is rotated on the first hinge 11 to the outer portion of the main body (clockwise direction of FIG. 1). That is, when the first lever 20 is rotated in the clockwise direction, the outer surface 22*a* of the bottom end 22 of the first lever 20 is formed to contact a second fixing protrusion 8 of the housing 7 of the fixing unit 3 and to rotate the elastic support member 10 on the first hinge 11 in the clockwise direction. When the first lever 20 is rotated in the clockwise direction at a predetermined angle, the first lever 20 is fixed to the housing 7 of the fixing unit 3 by a fixing member 27. Accordingly, the pressurizing roller 5 is separated from the heating roller 4 by a predetermined distance, and the elastic support member 10 does not return to the original position in which the pressurizing roller 5 and the heating roller 4 contact each other by the tension force of the first elastic member 12.

The fixing member 27 to prevent the elastic support member 10 from returning to the original position by the tension force of the first elastic member 12 may be formed in various types. As illustrated in FIGS. 2 and 3C, the fixing member 27 includes a first fixing protrusion 26 formed on the bottom end 22 of the first lever 20, and a second fixing protrusion 8 formed on the housing 7 of the fixing unit 3 to correspond to the first fixing protrusion 26. Therefore, when the first fixing protrusion 26 of the first lever 20 is hooked on the second fixing protrusion 8 of the housing 7 by rotation of the first lever 20, the elastic support member 10 does not return to the original position by the tension force of the first elastic member 12.

When the side cover 30 is opened, the top end 23 of the first lever 20 interferes with a second lever 32 of the side cover 30, so that the first lever 20 is rotated on the second hinge 21 in the clockwise direction. In addition, when the bottom end 22 of the first lever 20 is fixed to the housing 7, the top end 23 of the first lever 20 does not interfere with the second lever 32.

A second elastic member 24 to maintain a predetermined angle between the first lever 20 and the elastic support member 10 is installed at one side of the first lever 20. Here, the predetermined angle is determined to rotate the top end 23 of the first lever 20 in the clockwise direction by the side cover 30, when the side cover 30 is opened. For example, when the elastic support member 10 is located in the original position, the second elastic member 24 is installed so that the first lever 20 maintains approximately 90° to the extended end 15 of the elastic support member 10. The original position of the elastic support member 10 is the position of the elastic support member 10 in a state where the pressurizing roller 5 pressurizes the heating roller 4. A torsion spring is used as the second elastic member 24. Still referring to FIGS. 1 and 2, one arm of the torsion spring 24 is supported by a support unit 9 formed in the housing 7, and the other arm of the torsion spring 24 is supported by a stopper 25 formed at one side of the top end 23 of the first lever 20.

The side cover 30 is hinge-coupled to one side of the main body 101 of the image forming apparatus by a third hinge 31 to be rotated at a predetermined angle. The first lever 20 is operated by the opening/closing operation of the side cover 30. That is, when the side cover 30 is opened at a predetermined angle, the first lever 20 is rotated on the second hinge 21 in the open direction of the side cover 30 (clockwise direction of FIG. 1), and the elastic support member 10 is rotated on the first hinge 11 in the open direction of the side cover 30 (clockwise direction of FIG. 1) so as to separate the pressurizing roller 5 from the heating roller 4. Conversely, when the side cover 30 is closed, the first lever 20 is rotated on the second hinge 21 in the close direction of the side cover 30 (counterclockwise direction of FIG. 1), and the elastic support member 10 is rotated on the first hinge 11 in the close direction of the side cover 30 (counterclockwise direction of FIG. 1) so as to pressurize the heating roller 4 by the pressurizing roller 5.

The first lever 20 may be operated by the opening/closing operation of the side cover 30 in various forms. In this embodiment, as shown in FIG. 1, the second lever 32 and the third lever 33 are used. The second lever 32 is installed at the upper portion of the inner portion of the side cover 30. While the side cover 30 is opened, the second lever 32 pushes the top end 23 of the first lever 20 to rotate the first lever 20 in the clockwise direction. In addition, when the first lever 20 is rotated at a predetermined angle and fixed to the housing 7 of the fixing unit 3 by the fixing member 27, the second lever 32 does not interfere with the top end 23 of the first lever 20. When the side cover 30 is closed, the third lever 33 installed inside the side surface of the side cover 30 pushes the first lever 20 fixed to the housing 7 of the fixing unit 3 to rotate the first lever 20 on the second hinge 21 in the counterclockwise direction. Where the elastic support member 10 is located in the original position, the third lever 33 does not interfere with the first lever 20.

The operation of the rollers separating unit in accordance with an aspect of the present invention will now be described with reference to FIGS. 3A to 3C and FIGS. 4A to 4D.

Figure 3A:
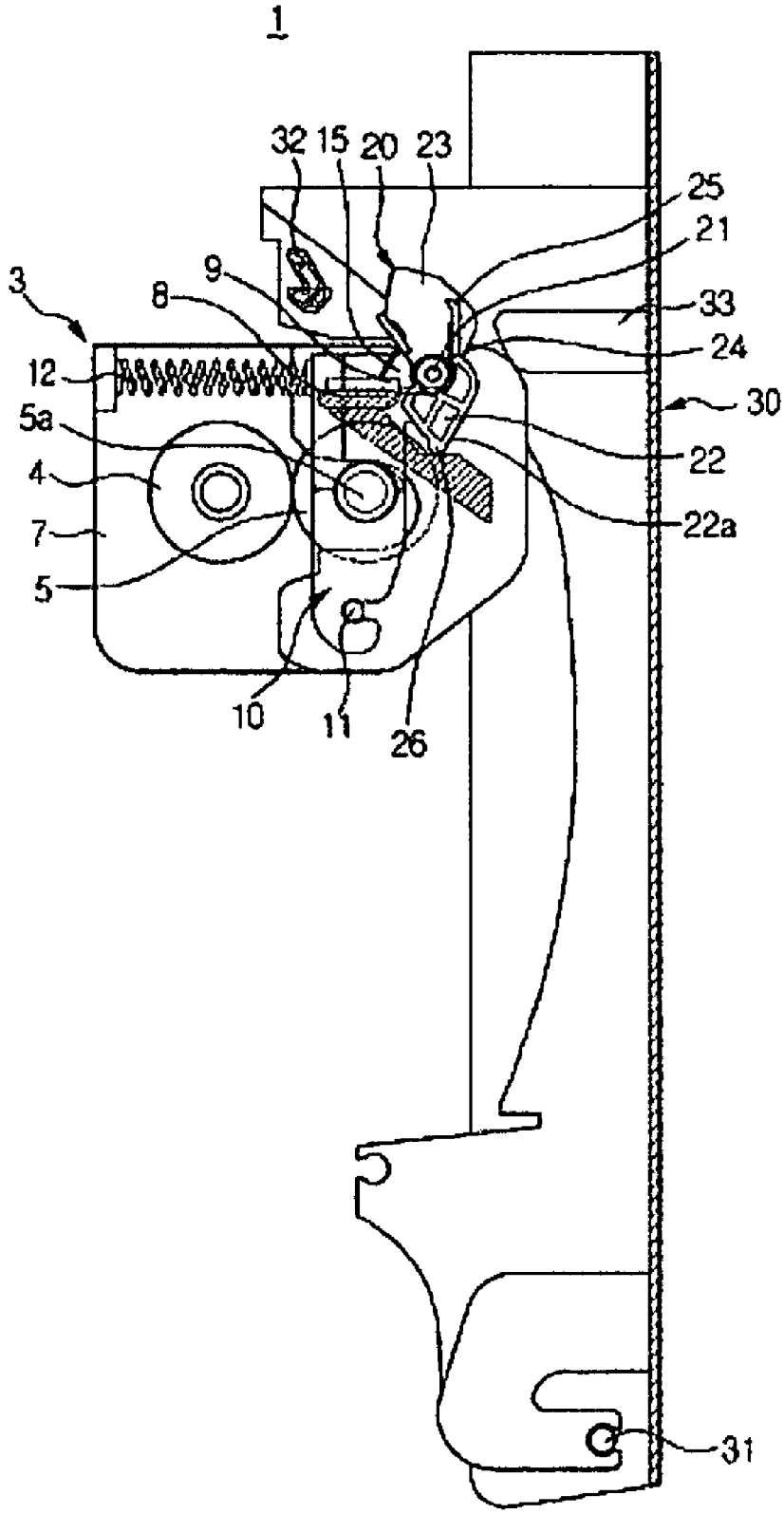
FIGS. 3A to 3C are side-sectional diagrams illustrating the operation of the rollers separating unit when a side cover is opened.

FIG. 3A shows the closed state of the side cover 30. The pressurizing roller 5 pressurizes the heating roller 4 by the tension force of the first elastic member 12. Here, the first lever 20 is located at a right angle to the extended end 15 of the elastic support member 10 by the second elastic member 24. The second lever 32 and the third lever 33 do not interfere with the first lever 20. In this state, when the user opens the side cover 30 to remove jammed paper, the side cover 30 starts to be rotated on the third hinge 31 in the clockwise direction.

Figure 3B:
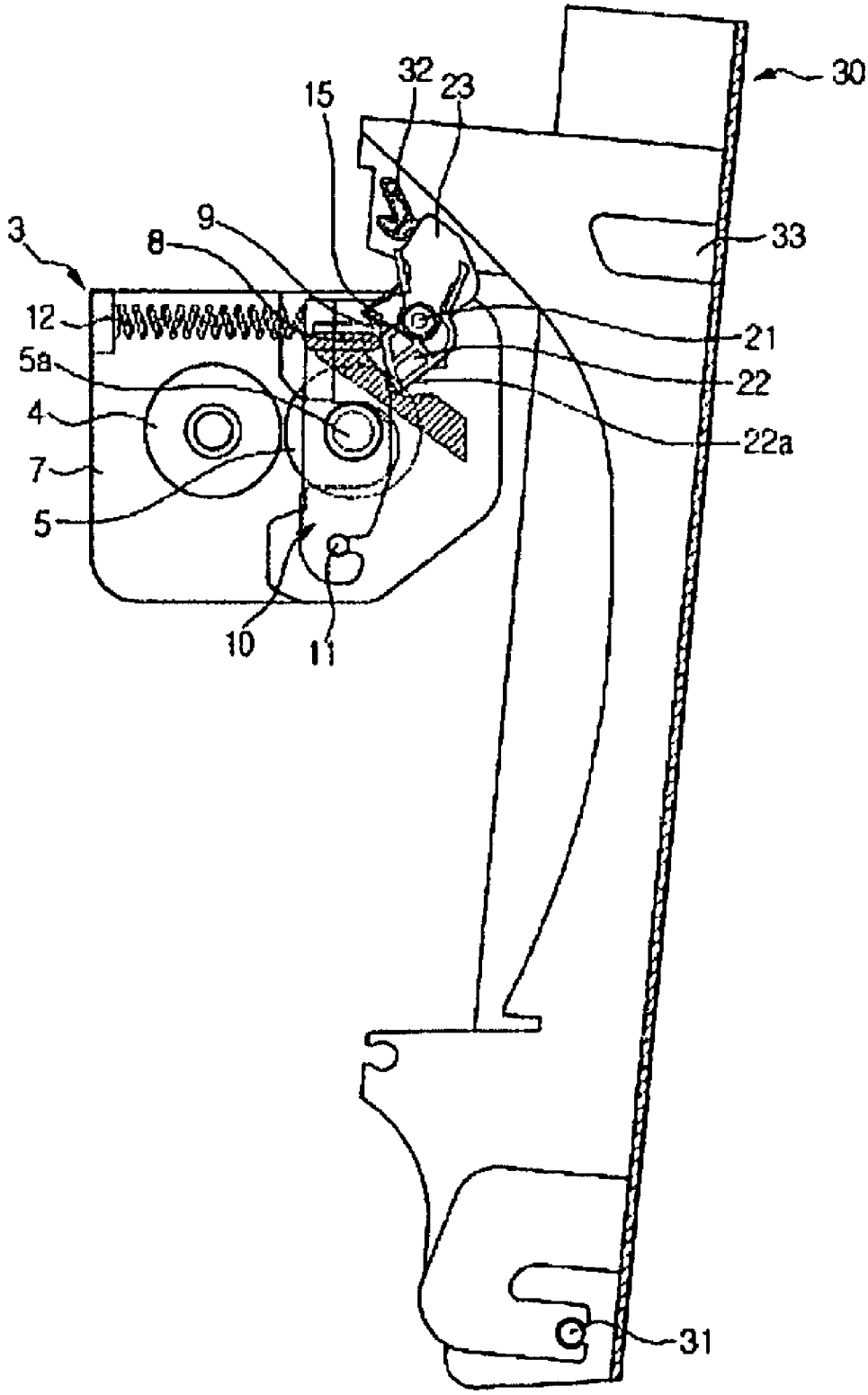
Figure 3C:
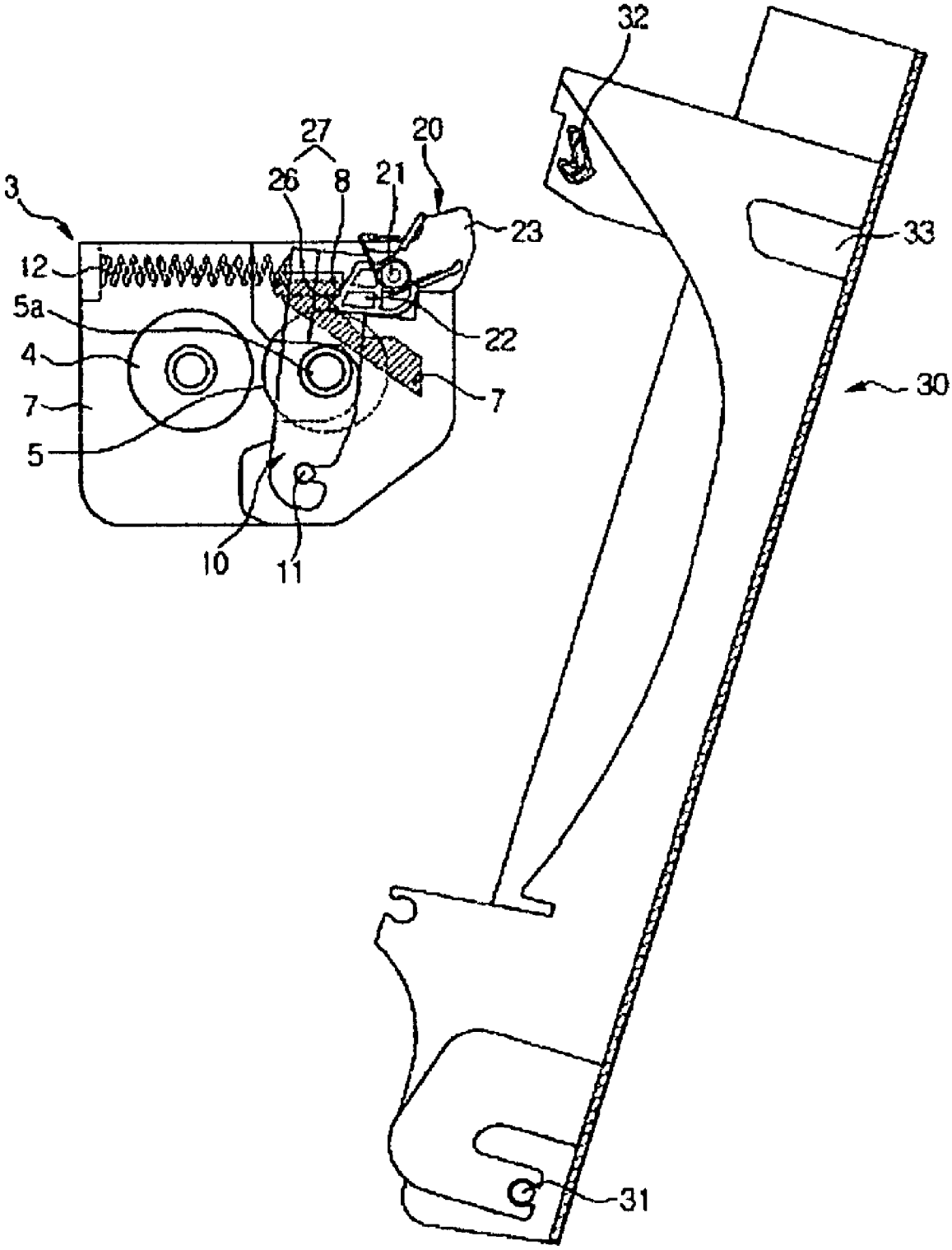

When the side cover 30 is rotated in the clockwise direction at a predetermined angle, as shown in FIG. 3B, the second lever 32, installed at the upper portion of the inner portion of the side cover 30, pushes the top end 23 of the first lever 20 in the clockwise direction. Accordingly, the first lever 20 is rotated on the second hinge 21 in the clockwise direction. When the first lever 20 is rotated in the clockwise direction at a predetermined angle, the outer surface 22*a* of the bottom end 22 of the first lever 20 is rotated while remaining in contact with the second fixing protrusion 8 of the housing 7 of the fixing unit 3. The elastic support member 10 is rotated on the first hinge 11 in the clockwise direction by rotation of the first lever 20. When the elastic support member 10 is rotated on the first hinge 11 in the clockwise direction, the first elastic member 12 is tensed, and, thus, the pressurizing roller 5, which is supported by the middle portion of the elastic support member 10, is separated from the heating roller 4.

With reference to FIG. 3B and then to FIG. 3C, when the first fixing protrusion 26 of the first lever 20 interferes with the second fixing protrusion 8, the first lever 20 is no longer rotated and is fixed to the housing 7 of the fixing unit 3. Since the second lever 32 does not interfere with the top end 23 of the first lever 20, the side cover 30 is rotated on the third hinge 31 at a predetermined angle, and, thus, completely opened (refer to FIG. 3C). Here, the heating roller 4 and the pressurizing roller 5 are separated from each other at a predetermined distance, and the upper portion of the fixing unit 3 is completely opened, so that the user may relatively easily remove paper that is jammed between the heating roller 4 and the pressurizing roller 5.

Figure 4A:
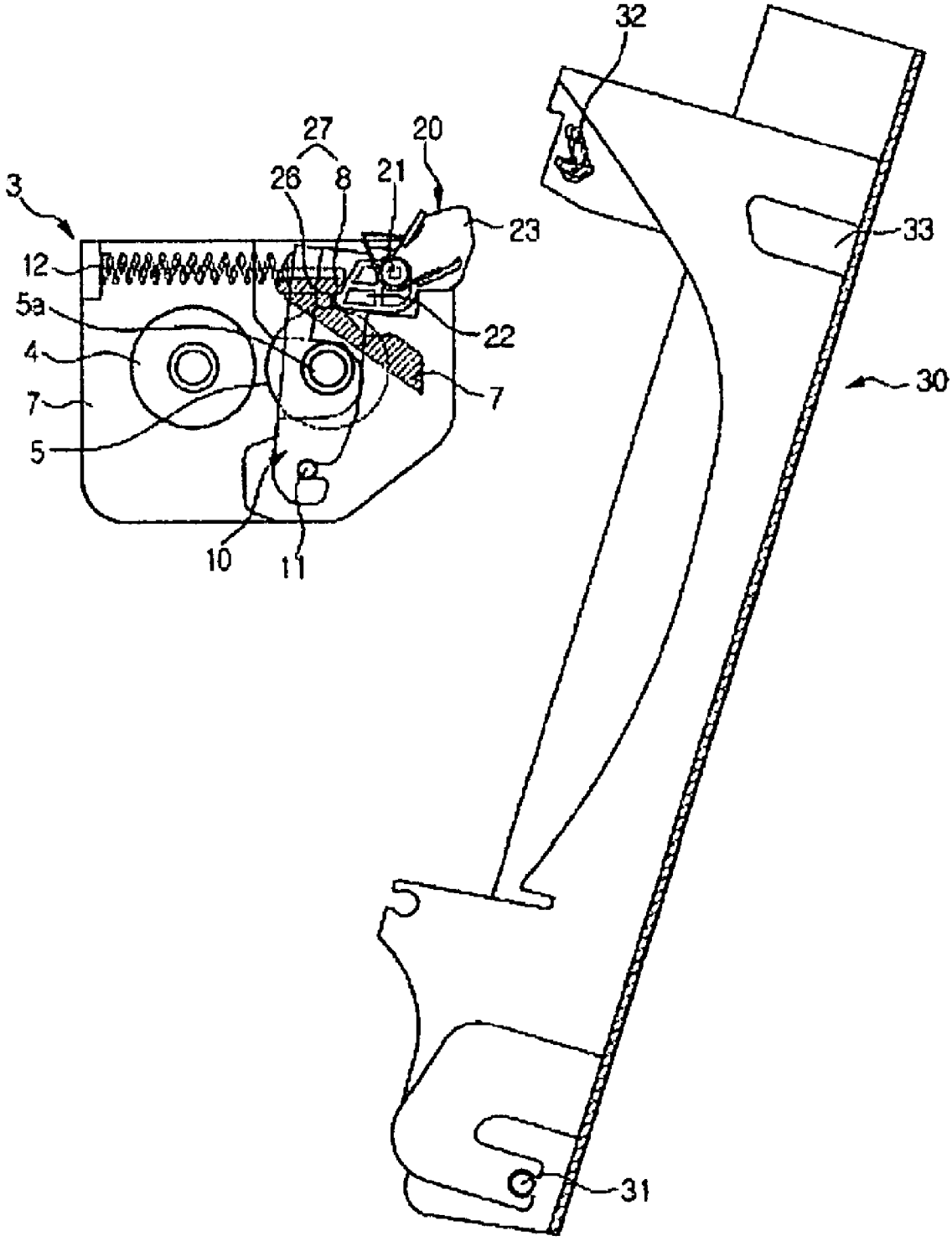
FIGS. 4A to 4D are side-sectional diagrams illustrating the operation of the rollers separating unit when the side cover is closed.
Figure 4B:
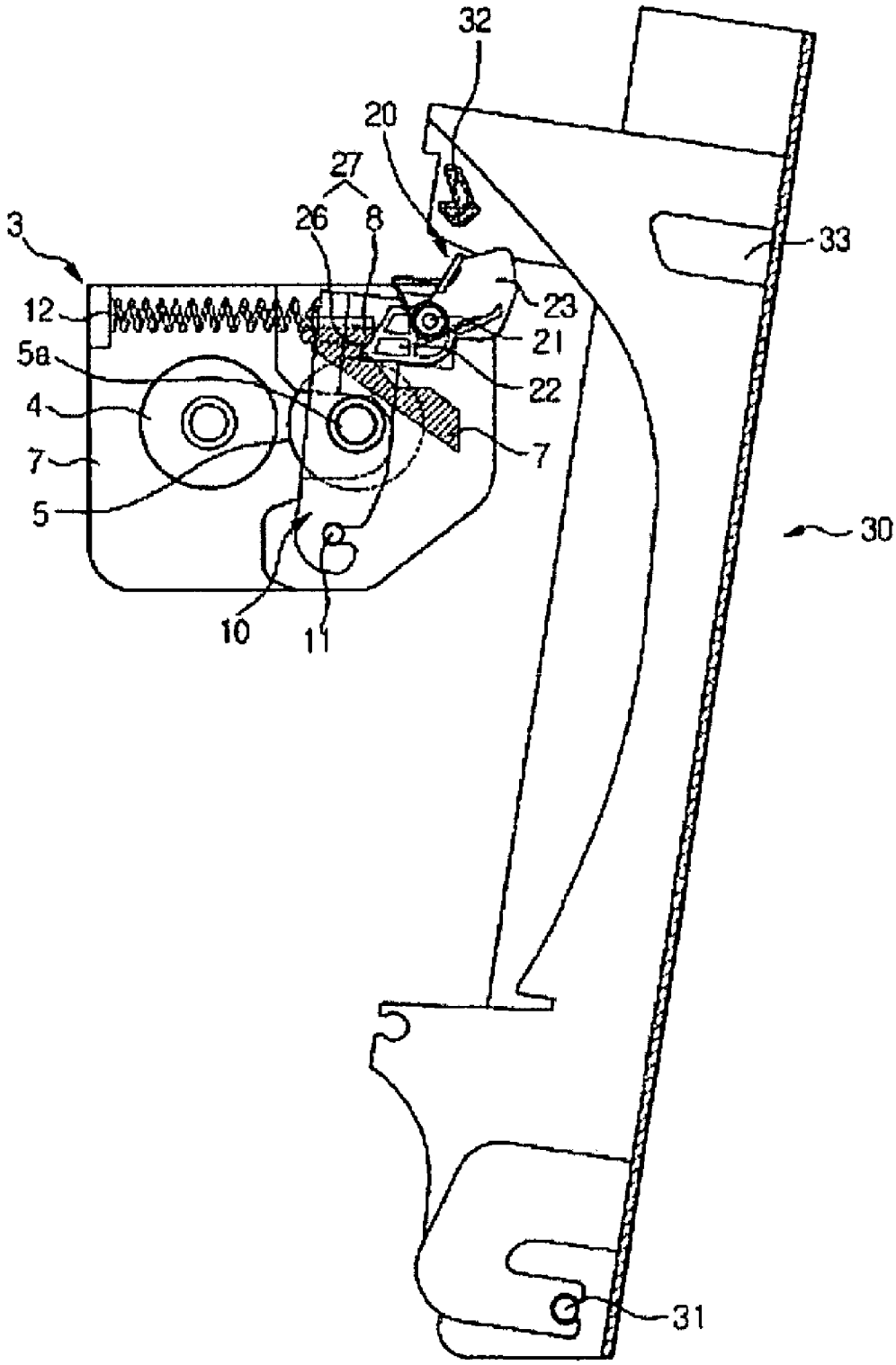
Figure 4C:
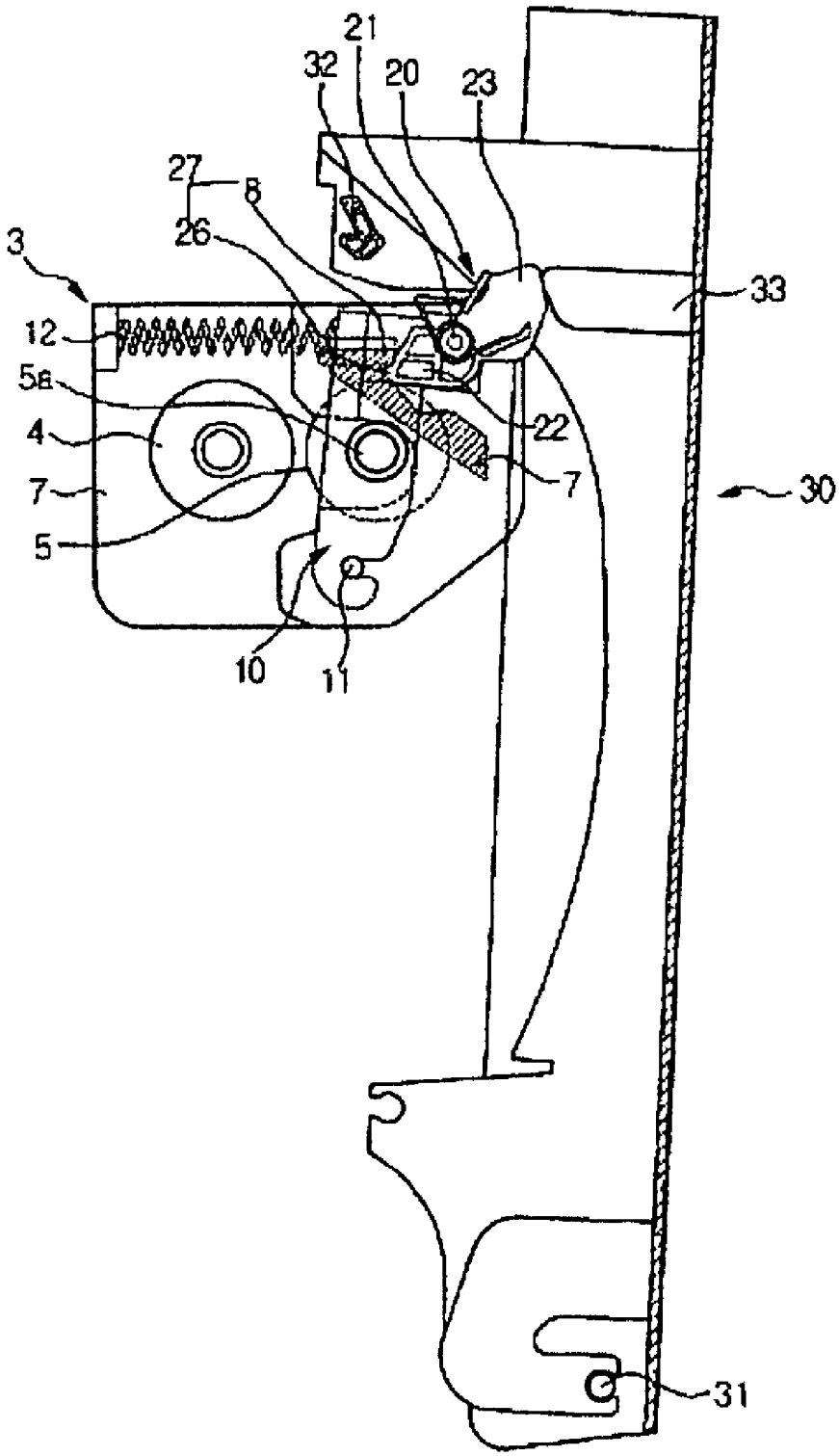
Figure 4D:
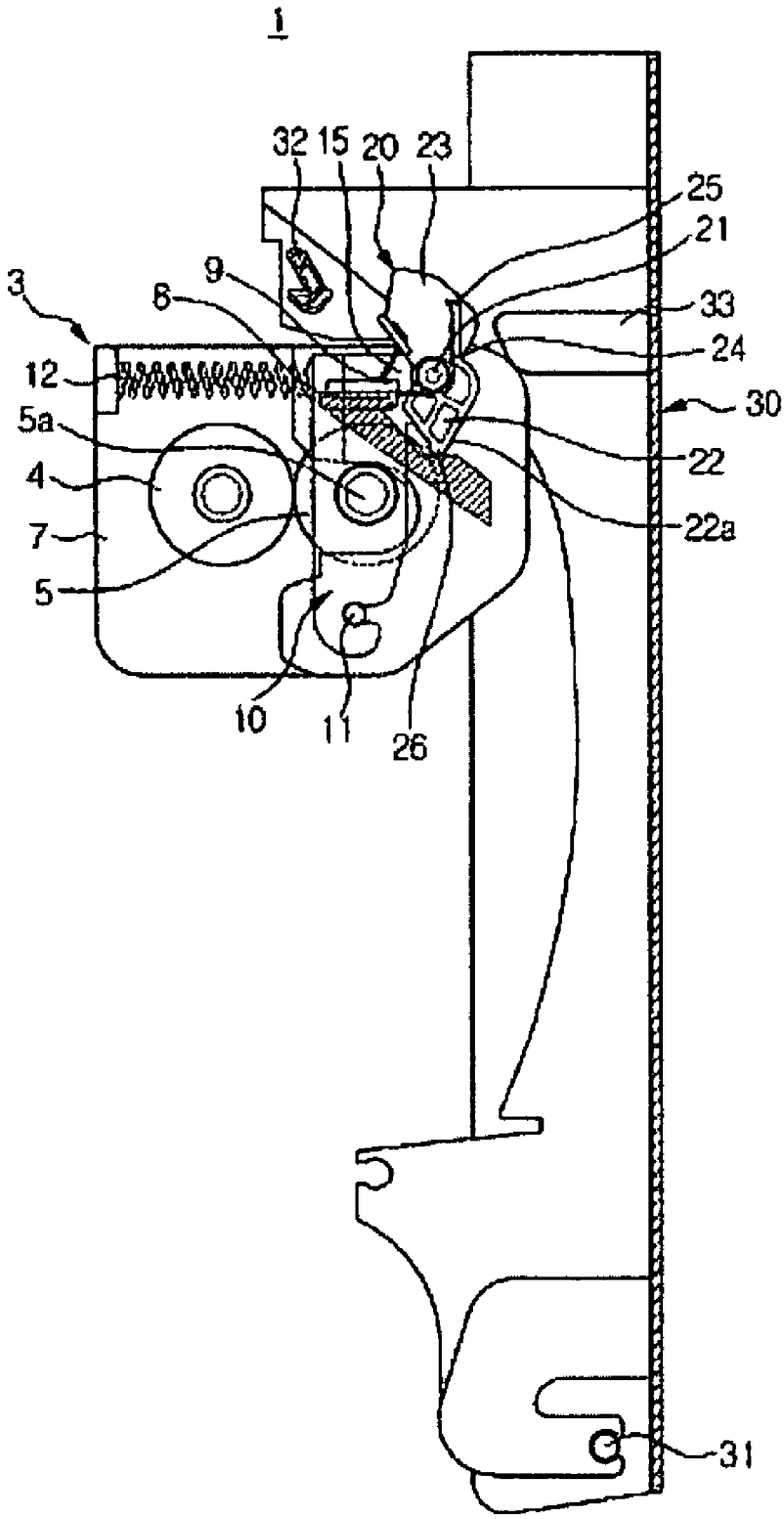

After removing the jammed paper, the user closes the opened side cover 30 as shown in FIG. 4A. As the side cover 30 is closed, the side cover 30 is rotated on the third hinge 31 in the counterclockwise direction. As illustrated in FIG. 4B, the second lever 32 passes over the first lever 20 without interfering with the first lever 20. Once the side cover 30 is rotated on the third hinge 31 at a predetermined angle, the third lever 33 interferes with the first lever 20 and pushes the first lever 20 in the counterclockwise direction (refer to FIG. 4C). When the first lever 20 receives force from the third lever 33 in the counterclockwise direction, the first fixing protrusion 26 is separated from the second fixing protrusion 8, and the outer surface 22*a* of the bottom end 22 of the first lever 20 is rotated in the counterclockwise direction in contact with the second fixing protrusion 8 of the housing 7. Here, the elastic support member 10 is also rotated on the first hinge 11 in the counterclockwise direction by the tension force of the first elastic member 12. When the pressurizing roller 5 returns to the position of pressurizing the heating roller 4 by rotation of the elastic support member 10, the first lever 20 returns to the position of having a right angle to the extended end 15 of the elastic support member 10 (refer to FIG. 4D).

Figure 5A:
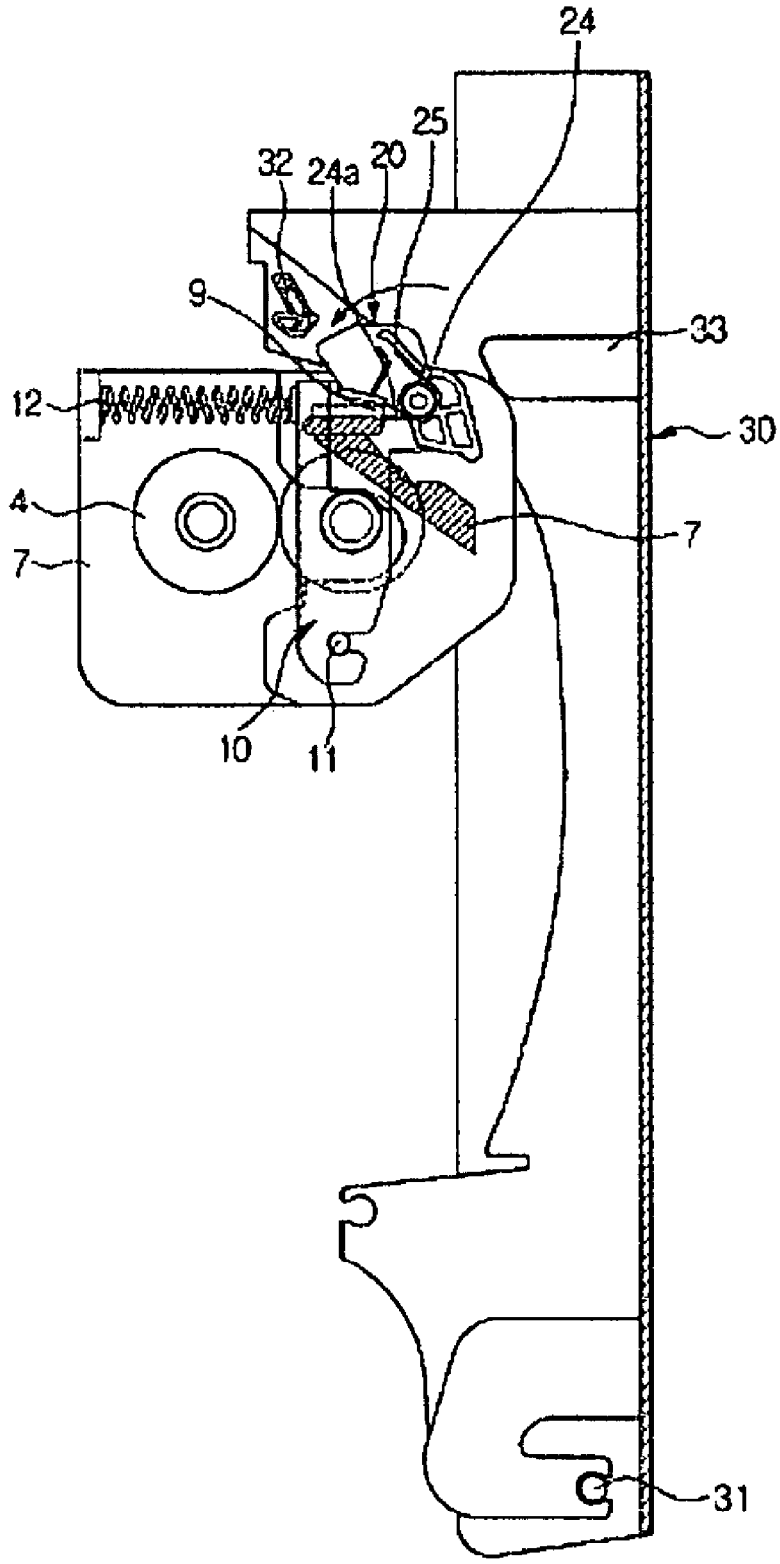
FIGS. 5A and 5B are side-sectional diagrams illustrating the operation of returning a first lever to the original position by a second elastic member of the rollers separating unit in accordance with the present invention.
Figure 5B:
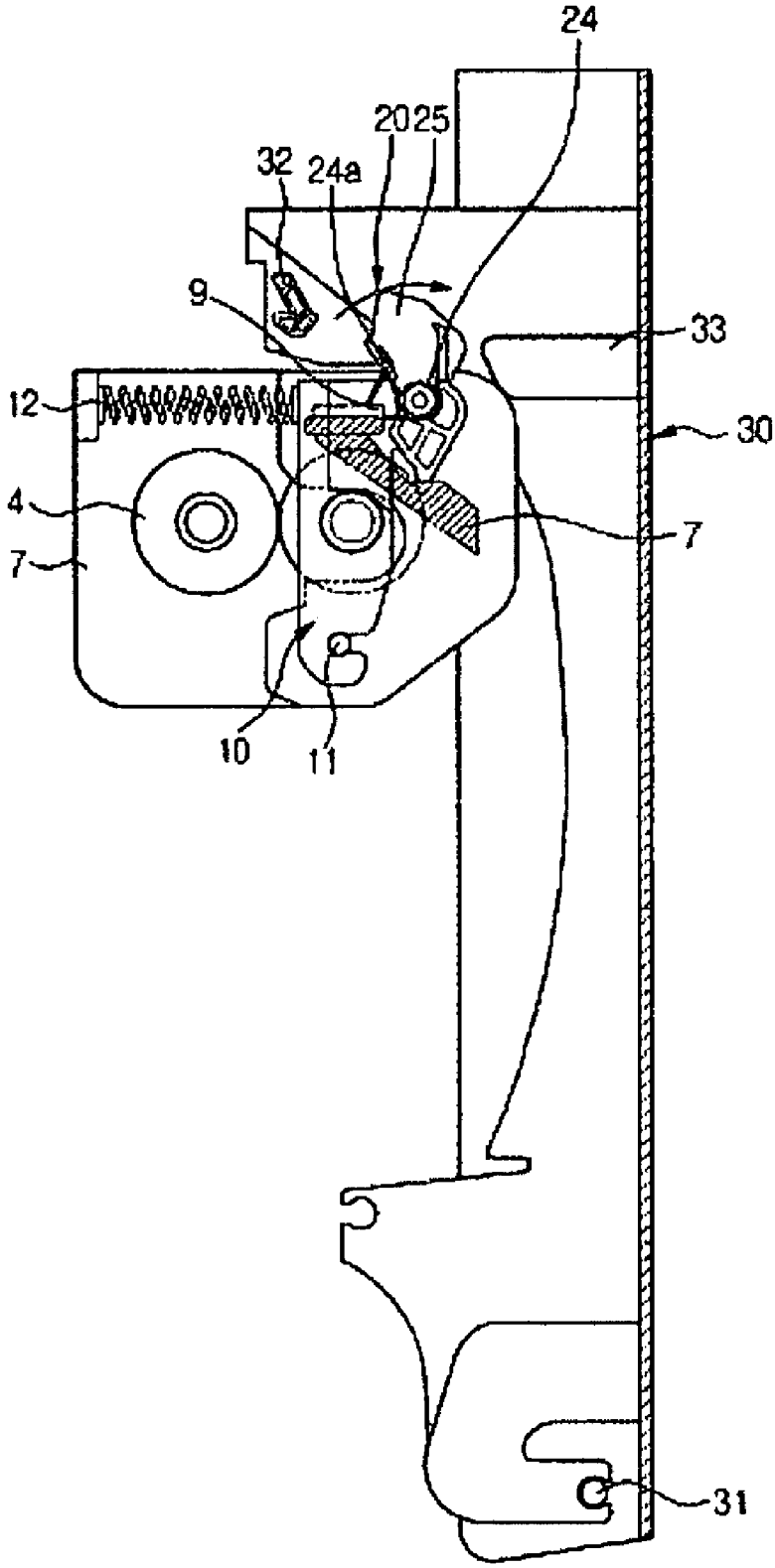

When the top end 23 of the first lever 20 is excessively rotated toward the support unit 9 of the housing 7 by the user or as a result of an exertion of another external force, as shown in FIG. 5A, if the external force is released, the first lever 20 returns to the original position as a result of the elasticity of the second elastic member 24 as shown in FIG. 5B. Accordingly, the first lever 20 is substantially always operated by the second lever 32.

In the rollers separating unit, the distance between the heating roller 4 and the pressurizing roller 5 is increased merely by opening the side cover 30, so that the user may relatively easily remove jammed paper. In addition, the pressurizing roller 5 returns to the position of pressurizing the heating roller 4 merely by closing the side cover 30, so that the user may rapidly resume the printing operation.

In the above-described embodiment, the elastic support member 10 moves the pressurizing roller 5 so that the heating roller 4 and the pressurizing roller 5 are separated from each other. Conversely, the elastic support member 10 may move the heating roller 4 so that the heating roller 4 and the pressurizing roller 5 are separated from each other.

Figure 6:
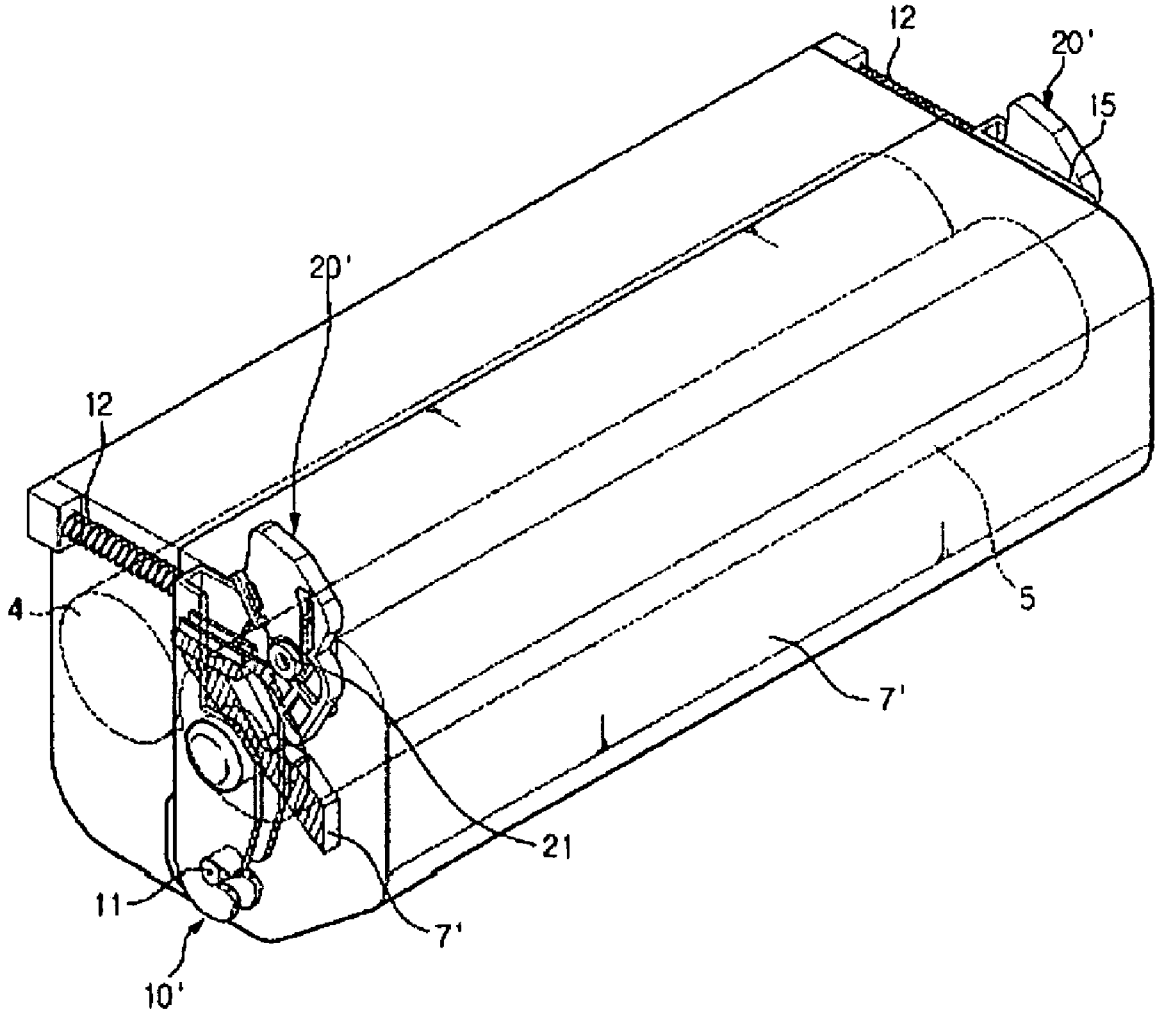
FIG. 6 is a perspective diagram illustrating a rollers separating unit in accordance with a second embodiment of the present invention.

Referring to FIG. 6, a rollers separating unit in accordance with a second embodiment of the present invention is installed in a fixing unit, and includes a pair of elastic support members 10', a pair of first levers 20' and a side cover 30 (refer to FIG. 1).

The structure of the pair of elastic support members 10' is identical to the structure of the elastic support member 10, as described above, except that the pair of elastic support members 10' are hinge-coupled to both sides of a housing 7' of the fixing unit 3 by the first hinge 11.

A structure of the pair of first levers 20' is identical to the structure of the first lever 20 except that the pair of first levers 20' are installed in the pair of elastic support members 10' by the second hinge 21.

As in the first embodiment, the side cover 30 is rotatably installed in the main body 101 (refer to FIG. 7) of the image forming apparatus by the third hinge 31 (refer to FIG. 1). The pair of first levers 20' are operated at the same time by the open/close operation of the side cover 30, so that the pair of elastic support members 10' can be rotated on the first hinge 11 at the same time. Accordingly, in order to operate the first lever 20 by the second lever 32 and the third lever 33, as in the first embodiment, the second lever 32 and the third lever 33 are installed in pairs to operate the pair of first levers 20'.

The operation of the rollers separating unit of the second embodiment is similar to the operation of the rollers separating unit of the first embodiment, and, thus, detailed explanations thereof are omitted.

Figure 7:
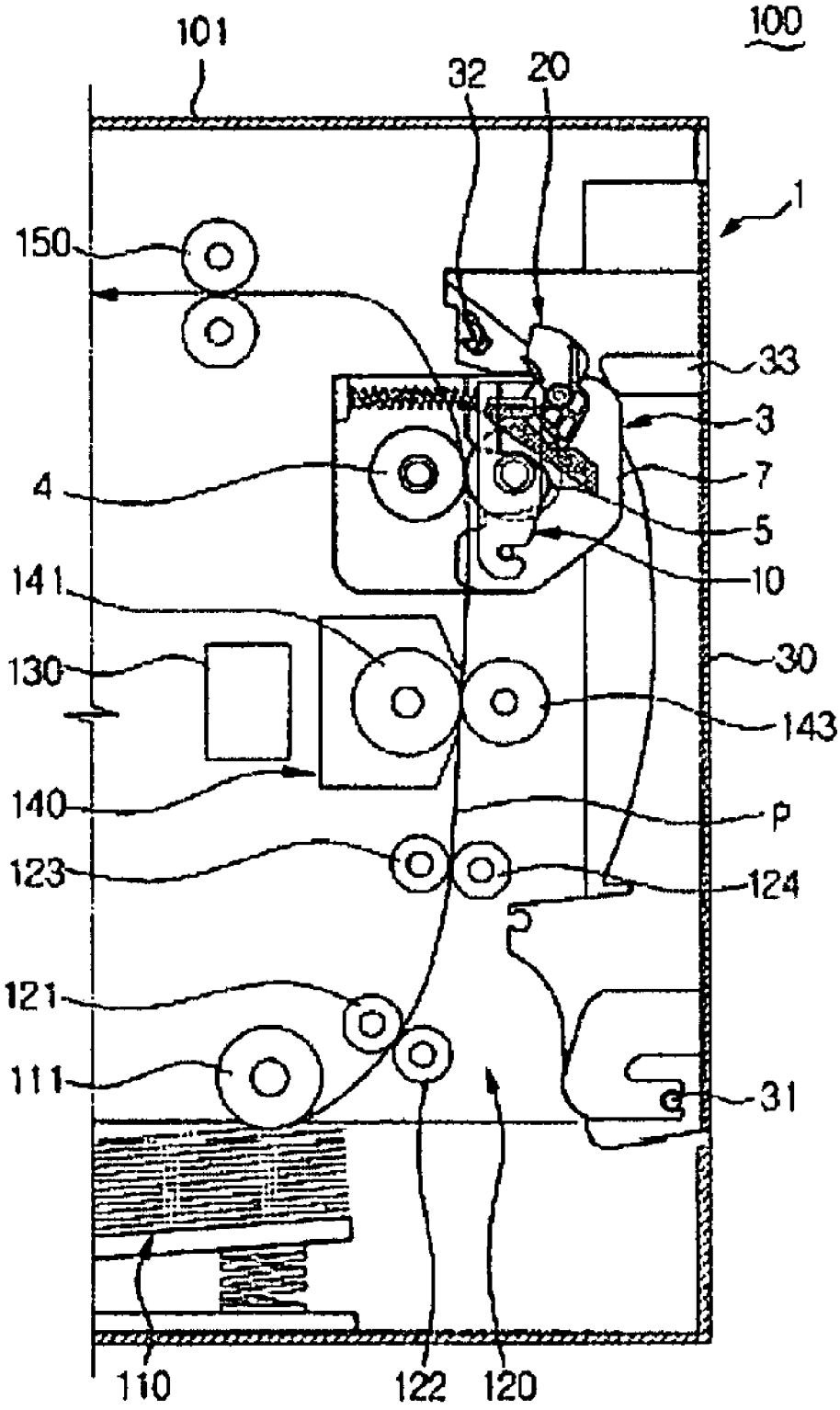
FIG. 7 is a schematic partial side-sectional diagram illustrating one example of an image forming apparatus having the rollers separating unit in accordance with the present invention.

FIG. 7 is a schematic diagram illustrating one example of the image forming apparatus 100 having the rollers separating unit 1 installed therein in accordance with the present invention.

As illustrated in FIG. 7, the image forming apparatus 100 having the rollers separating unit 1 includes a paper feeding unit 110, a paper transfer unit 120, an exposure unit 130, an image forming unit 140, a transcribing roller 143, a fixing unit 3, a rollers separating unit 1 and a main body housing 101.

Paper P is stacked on the paper feeding unit 110. The paper feeding unit 110 has a pickup roller 111 to pick up and feed the paper P one sheet by one sheet. The paper transfer unit 120 supplies the paper P picked up by the paper feeding unit 110 between the image forming unit 140 and the transcribing roller 143, and includes a feed roller 121 to transfer the paper P, a second roller 122 to work in concert with the feed roller 121, a regulating roller 123 to regulate the front end of the paper P, and a first roller 124 to work in concert with the regulating roller 123. The exposure unit 130 emits laser beams to a photoconductor 141 according to printing data. The image forming unit 140 includes the photoconductor 141 on which an electrostatic latent image is formed, and a developing unit to develop the electrostatic latent image into a visible image by the toner. The transcribing roller 143 is installed to be rotated to face the photoconductor 141, to transcribe the visible image formed on the photoconductor 141 to the paper P from the paper feeding unit 110. The fixing unit 3 includes a pressurizing roller 5 and a heating roller 4 rotated in contact with each other, and a housing 7 to support the pressurizing roller 5 and the heating roller 4. The fixing unit 3 fixes the toner image to the paper P passing between the pressurizing roller 5 and the heating roller 4 by applying heat and pressure. The rollers separating unit 1 includes an elastic support member 10 rotatably supported by the housing 7 of the fixing unit 3, to elastically support the pressurizing roller 5, a first lever 20 hinge-coupled to an extended end 15 of the elastic support member 10, to rotate the elastic support member 10 according to the opening/closing operation of the side cover 30, and the side cover 30 hinge-coupled to the main body housing 101, to open the upper portion of the fixing unit 3 so as to remove jammed paper from the fixing unit 3. The aforementioned units and the guide members composing paths of the paper P are installed in the main body housing 101.

When a control unit (not shown) receives a printing command, the exposure unit 130 emits laser beams corresponding to the printing data received by the control unit to the photoconductor 141. An electrostatic latent image corresponding to the laser beams is formed on the surface of the photoconductor 141. When the photoconductor 141 is rotated, the electrostatic latent image is developed as a visual image by the toner supplied from the developing unit. Here, the pickup roller 111 of the paper feeding unit 110 picks up a piece of paper P from the stacked paper P, and transfers the paper P to the feed roller 121. The picked-up paper P is transferred between the image forming unit 140 and the transcribing roller 143 with its front end aligned by the feed roller 121 and the regulating roller 123. When the paper P enters into the transcribing roller 143, the visual image formed on the photoconductor 141 is transcribed on the paper P by the transcribing roller 143. The paper P on which the image has been transcribed is transferred between the pressurizing roller 5 and the heating roller 4 of the fixing unit 3. The image of the paper P entering into the fixing unit 3 is fixed to the paper P by pressure of the pressurizing roller 5 and heat of the heating roller 4. The paper P to which the image has been fixed is then externally discharged from the main body housing 101 by a discharging roller 150.

Figure 8:
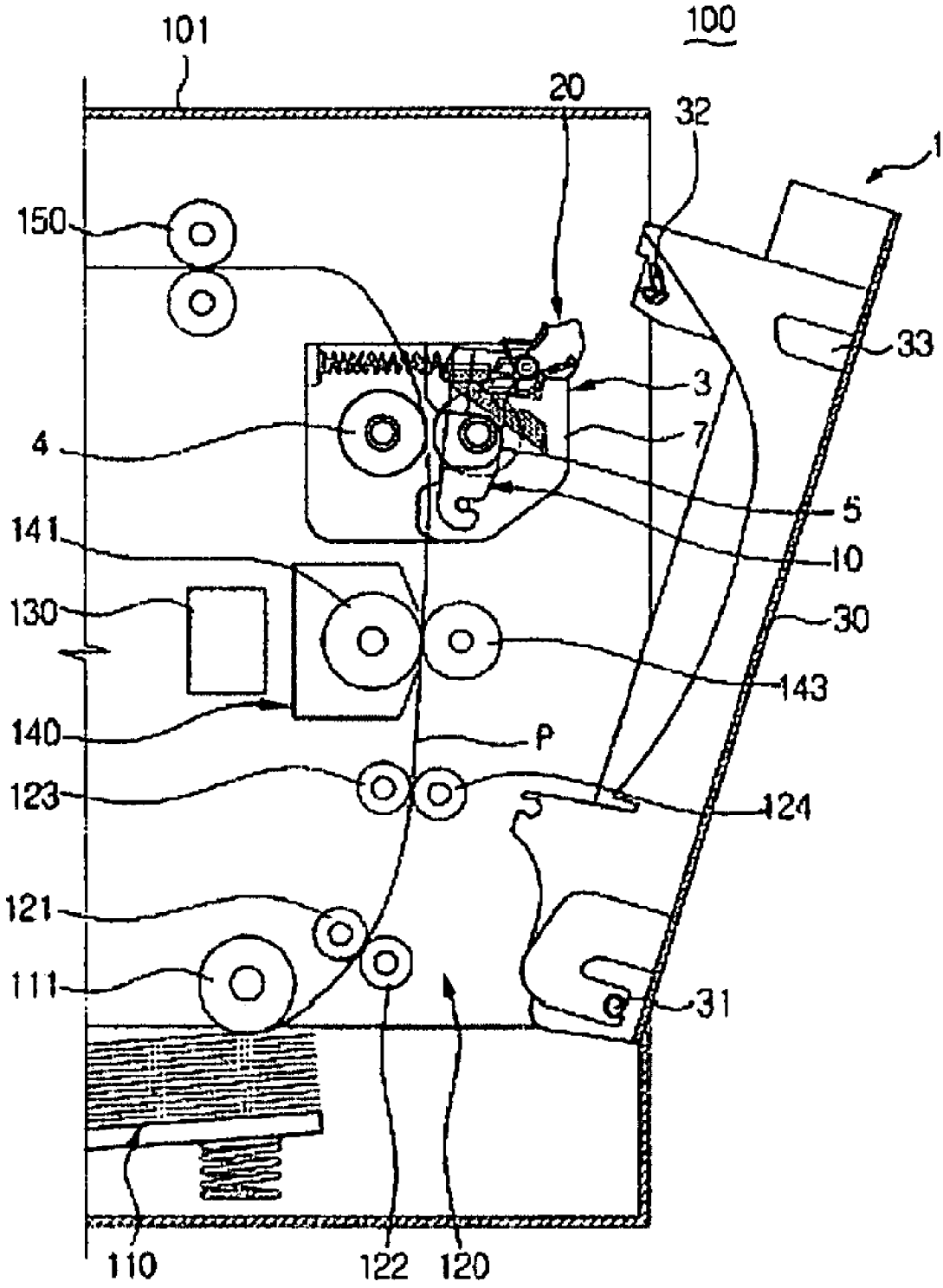
FIG. 8 is a schematic partial side-sectional diagram illustrating the side cover open state of the image forming apparatus of the embodiment of FIG. 7.

During the printing operation, the paper P entering into the fixing unit 3 may not be normally transferred but, rather, may become jammed. When the paper P is jammed in the fixing unit 3, if the user opens the side cover 30, the heating roller 4 and the pressurizing roller 5 are separated from each other by the rollers separating unit 1 (refer to FIG. 8). Accordingly, the user may relatively easily remove the jammed paper from the fixing unit 3. When the user closes the side cover 30 after removing the jammed paper, the heating roller 4 and the pressurizing roller 5 are returned into contact with each other as shown in FIG. 7, so that the image forming apparatus 100 may resume the printing operation.

Here, the operation of the heating roller 4 being contacted and spaced away from the pressurizing roller 5 by opening/closing the side cover 30 has been described in the above embodiments of the rollers separating unit 1, and, thus, detailed explanations thereof are omitted.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A rollers separating unit of a fixing unit including first and second rollers that face each other, which is installed in a main body of an image forming apparatus, the rollers separating unit, comprising:

an elastic support member rotatably hinge-coupled to one side of a housing of the fixing unit, to elastically bias the first roller against the second roller, so that the first and second rollers pressurize each other;

a first lever rotatably hinge-coupled to one end of the elastic support member, to rotate the elastic support member at a first predetermined angle, so that the first and second rollers are separated from each other;

a cover rotatably hinge-coupled to one side of the main body, to operate the first lever so as to increase a distance between the first and second rollers when the cover is opened, and a fixing member to fix the first lever to the housing of the fixing unit, when the first lever is rotated in an opening direction of the cover, at a second predetermined angle.

2. The rollers separating unit according to claim 1, wherein the cover comprises a second lever to rotate the first lever so that the elastic support member is rotated in an opening direction of the cover, when the cover is opened.

3. The rollers separating unit according to claim 1, wherein the cover comprises another lever to rotate the first lever so that the elastic support member is rotated in a closing direction of the cover, when the cover is closed.

4. The rollers separating unit according to claim 1, wherein the fixing member comprises a first fixing protrusion formed at one end of the first lever, and a second fixing protrusion formed in the housing of the fixing unit to correspond to the first fixing protrusion, such that when the first fixing protrusion is hooked on the second fixing protrusion as a result of a rotation of the first lever, the elastic support member is rotated as a result of the tension force of the first elastic member so as to be prevented from returning to an original position thereof.

5. The rollers separating unit according to claim 1, further comprising a second elastic member to elastically support the first lever so that the first lever maintains a third predetermined angle to the elastic support member when the first and second rollers contact each other.

6. The rollers separating unit according to claim 1, further comprising a first elastic member installed between the housing of the fixing unit and one end of the elastic support member, to draw the elastic support member in a direction towards the main body.

7. A rollers separating unit of a fixing unit including a heating roller and a pressurizing roller facing each other, which is installed in a main body of an image forming apparatus, the rollers separating unit comprising:

a pair of elastic support members rotatably hinge-coupled to both sides of a housing of the fixing unit, to elastically bias the pressurizing roller against the heating roller, to pressurize the heating roller;

a pair of first levers rotatably hinge-coupled to one end of the pair of elastic support members, to rotate the pair of elastic support members at a first predetermined angle so that the heating roller and the pressurizing roller are separated from each other;

a cover rotatably hinge-coupled to one side of a main body to operate the pair of first levers, so as to increase a distance between the heating roller and the pressurizing roller when the cover is opened, and a pair of fixing members to fix the first levers to the housing of the fixing unit, when the first levers are rotated in an opening direction of the cover, at a second predetermined angle.

8. The rollers separating unit according to claim 7, wherein the cover comprises a pair of second levers to rotate the pair of first levers so that the elastic support members are rotated in an opening direction of the cover, when the cover is opened.

9. The rollers separating unit according to claim 7, wherein the cover comprises another pair of levers to rotate the pair of first levers so that the elastic support members are rotated in a closing direction of the cover, when the cover is closed.

10. The rollers separating unit according to claim 7, wherein the fixing members comprise a pair of first fixing protrusions formed at ends of the first levers, and a pair of second fixing protrusions formed in the housing of the fixing unit, which correspond to the first fixing protrusions.

11. The rollers separating unit according to claim 7, further comprising second elastic members to elastically support the first levers so that the first levers maintain a third predetermined angle with respect to the elastic support members, when the heating and pressurizing rollers contact each other.

12. The rollers separating unit according to claim 7, wherein the elastic support members comprise a pair of first elastic members installed between the housing of the fixing unit and ends of the elastic support members, to draw the elastic support members toward the main body.

13. An image forming apparatus including a fixing unit having a pressurizing roller and a heating roller facing each other, the image forming apparatus, comprising:

a pair of elastic support members rotatably hinge-coupled to both sides of a housing of the fixing unit, to elastically bias the pressurizing roller against the heating roller, to pressurize the heating roller;

a pair of first levers rotatably hinge-coupled to one end of the pair of elastic support members, to rotate the pair of elastic support members at a first predetermined angle so that the heating roller and the pressurizing roller are separated from each other;

a cover rotatably hinge-coupled to one side of a main body, to increase a distance between the heating roller and the pressurizing roller, by operating the pair of first levers when the cover is opened, and a pair of fixing members to fix the first levers to the housing of the fixing unit, when the first levers are rotated in the opening direction of the cover, at a second predetermined angle.

14. The image forming apparatus according to claim 13, wherein the cover comprises a pair of second levers to rotate the pair of first levers so that the elastic support members are rotated in an opening direction of the cover, when the cover is opened.

15. The image forming apparatus according to claim 13, wherein the cover comprises another pair of levers to rotate the pair of first levers so that the elastic support members are rotated in a closing direction of the cover, when the cover is closed.

16. An apparatus to separate a pressurizing roller and a heating roller, the pressurizing roller being normally biased toward the heating roller, in a fixing unit of a main body of an image forming apparatus, comprising:

an elastic support member coupled to a first hinge one side of a housing of the fixing unit, to elastically bias the pressurizing roller against the heating roller;

a first lever rotatably hinge-coupled to one end of the elastic support member, to rotate the elastic support member at a first predetermined angle, so that the pressurizing roller and the heating roller are separated from each other;

a cover rotatably hinge-coupled to one side of the main body to operate the first lever, so as to increase a distance between the pressurizing roller and the heating roller when the cover is opened, and a first elastic member installed between a top end of the elastic support member and the housing, to allow the pressurizing roller to pressurize the heating roller, by biasing the elastic support member on the first hinge.

17. The apparatus according to claim 16, wherein a bottom end of the elastic support member is installed in the housing, and a middle portion thereof rotatably supports an axis of the pressurizing roller.

18. The apparatus according to claim 16, further comprising a second hinge to hinge-couple the first lever to an extended end outwardly extended from the top end of the elastic support member.

19. The apparatus according to claim 18, further comprising a second fixing protrusion to interfere with an outer surface of the bottom end of the first lever when the first lever is rotated to the outer portion of the main body so as to rotate the elastic support member on the first hinge.

20. The apparatus according to claim 19, wherein the first lever rotated and then fixed to the housing by a fixing member.

21. The apparatus according to claim 20, wherein the fixing member comprises a first fixing protrusion formed on the bottom end of the first lever, and wherein the second fixing protrusion is formed on the housing to correspond to the first fixing protrusion such that, when the first fixing protrusion is hooked on the second fixing protrusion by the rotation of the first lever, the elastic support member is rotated by the tension force of the first elastic member and is prevented from return to an original position thereof.

22. The apparatus according to claim 20, further comprising a second lever of the cover to interfere with the top end of the first lever when the cover is opened, so that the first lever is rotated on the second hinge, wherein, when the bottom end of the first lever is fixed to the housing, the top end of the first lever is prevented from interfering with the second lever.

23. The apparatus according to claim 22, further comprising a second elastic member, to maintain a second predetermined angle between the first lever and the elastic support member, wherein the second predetermined angle is determined to allow for a rotation of the top end of the first lever by the cover, when the cover is opened.

24. The apparatus according to claim 23, further comprising a third hinge to hinge-couple the cover to one side of the main body.

25. The apparatus according to claim 24, wherein, when the cover is opened at a third predetermined angle, the first lever is rotated in an opening direction of the cover, and the elastic support member is rotated on the first hinge in the opening direction of the cover so as to separate the pressurizing roller from the heating roller, and, when the cover is closed, the first lever is rotated on the second hinge in a closing direction of the cover, and the elastic support member is rotated on the first hinge in the closing direction of the cover so as to bias the pressurizing roller toward the heating roller.

26. The apparatus according to claim 25, wherein the second lever is installed at an upper portion of the inner portion of the cover such that when the cover is opened, the second lever pushes the top end of the first lever so as to rotate the first lever.

27. An apparatus to separate a pressurizing roller and a heating roller, the pressurizing roller being normally biased toward the heating roller, in a fixing unit of a main body of an image forming apparatus, comprising:

a pair of elastic support members hinge-coupled to sides of a housing of the fixing unit, to elastically bias the pressurizing roller against the heating roller;

a pair of first levers rotatably hinge-coupled to one end of the pair of elastic support members, to rotate the pair of elastic support members at a predetermined angle so that the pressurizing roller and the heating roller are separated from each other;

a cover rotatably hinge-coupled to one side of the main body to operate the pair of first levers, so as to increase a distance between the heating and pressurizing rollers, when the cover is opened, and a pair of fixing members to fix the first levers to the housing of the fixing unit, when the first levers are rotated in an opening direction of the cover, at a second predetermined angle.

28. An image forming apparatus, comprising:

a fixing unit including a heating roller and a pressurizing roller, the pressurizing roller being normally biased toward the heating roller; and a separating unit to separate the pressurizing roller and the heating roller, wherein the separating unit comprises:

an elastic support member hinge-coupled to one side of a housing of the fixing unit, to elastically bias the pressurizing roller against the heating roller, a first lever rotatably hinge-coupled to one end of the elastic support member, to rotate the elastic support member at a predetermined angle so that the pressurizing roller and the heating roller are separated from each other, a cover rotatably hinge-coupled to one side of the main body to operate the first lever, so as to increase a distance between the pressurizing roller and the heating roller when the cover is opened, and a fixing member to fix the first lever to the housing of the fixing unit, when the first lever is rotated in an opening direction of the cover, at a second predetermined angle.

* * * * *